US005594192A

United States Patent [19]

Rodriguez

[11] Patent Number: 5,594,192

[45] Date of Patent: Jan. 14, 1997

[54] ACTIVE AMMUNITION MAGAZINE WITH IMPROVED CHAIN CONVEYOR

[75] Inventor: Derek A. Rodriguez, Milton, Vt.

[73] Assignee: Martin Marietta Corporation, King of Prussia, Pa.

[21] Appl. No.: 402,213

[22] Filed: Mar. 10, 1995

[51] Int. Cl.[6] ..... F41A 9/30; F41A 9/79

[52] U.S. Cl. ..... 89/33.16; 89/34; 89/35.01

[58] Field of Search ..... 89/33.14, 33.16, 89/34, 33.02, 35.01, 45, 33.1, 33.2, 33.25, 33.17

[56] References Cited

U.S. PATENT DOCUMENTS

| | | | |
|---|---|---|---|
| 2,265,166 | 12/1941 | Hoppert et al. | 89/35.01 |
| 4,252,049 | 2/1981 | Franz et al. | 89/34 |
| 4,263,837 | 4/1981 | Tassie | 89/34 |
| 4,496,041 | 1/1985 | Voillot | 198/457 |
| 4,700,609 | 10/1987 | Wiethoff et al. | 89/46 |
| 5,131,315 | 7/1992 | Maher et al. | 89/45 |
| 5,151,556 | 9/1992 | Maher et al. | 89/35.01 |
| 5,175,388 | 12/1992 | Maher et al. | 89/35.01 |
| 5,347,908 | 9/1994 | Mouterde et al. | 89/45 |
| 5,456,154 | 10/1995 | Golden | 89/34 |

FOREIGN PATENT DOCUMENTS

| | | | |
|---|---|---|---|
| 2207738 | 2/1989 | United Kingdom | 89/34 |

*Primary Examiner*—Stephen M. Johnson

*Attorney, Agent, or Firm*—Robert A. Cahill; Geoffrey H. Krauss

[57] ABSTRACT

A compact ammunition magazine of high storage density contains an endless ammunition conveyor running in a serpentine path. The conveyor includes a succession of units consisting of a pair of rigidly connected tubes that receive ammunition rounds in snug-fitting relation. The tube units are pivotally interconnected by links of a single conveyor chain that is driven by plural drive sprockets to index the tubes to a single magazine port through which uploading/downloading of ammunition rounds is conducted. Guide rollers, fitted on the tubes at positions laterally spaced from the conveyor chain, roll on horizontal tracks within the magazine to provide conveyor support and guidance.

26 Claims, 6 Drawing Sheets

ACTIVE AMMUNITION MAGAZINE WITH IMPROVED CHAIN CONVEYOR

FIELD OF THE INVENTION

The present invention relates to ammunition handling equipment and particularly to an active ammunition magazine conducive to automated uploading and downloading of large caliber rounds of ammunition.

BACKGROUND OF THE INVENTION

Future requirements for military fighting vehicles, such as tanks, call for an unparalleled combination of fire power and protection integrated into a highly mobile and transportable vehicle of lower weight and reduced signature size. To meet these requirements, all systems must be compact and lightweight and capable of being packaged in a fighting vehicle with minimal consumption of space, One system that has been particularly challenged to meet stringent space requirements is the armament system, particularly the ammunition handling aspects of the armament system. Ammunition rounds for the tank cannon must be stored in a safe and secure manner to withstand travel over rough terrain. Typically, the tank rounds are stored in one or more magazines located in the tank hull and/or turret bustle. The magazines must be designed to optimize storage density, thereby maximizing storage capacity consistent with available space that is not abundant. In the past, the task of retrieving rounds from the magazine(s) and loading them into the tank cannon was performed manually. Thus, considerable space within the tank hull and turret had to be allotted to accommodate body movements of a tank crew member necessary to retrieve and load the tank rounds. Also, such manual handling of tank rounds is not conducive to rapid fire action of the cannon in battle and jeopardizes the safety of the ammunition handling crew member.

To save at least some of the space required for the manual handling of tank ammunition, automated loading systems have been proposed and developed. Such autoloading systems successively retrieve tank rounds from a magazine(s) and load them into the tank cannon without intervention by a tank crew member. This autoloading approach to serving the tank cannon achieves a rapid firing rate and enhances crew safety.

One of the crucial components of an autoloading system is the magazine that must accommodate the successive retrievals of tank rounds incident to loading the tank cannon. Ammunition magazines are typically of two design approaches, i.e., passive and active. In the passive magazine design approach, the tank rounds are stored in stationary cells. The autoloader must then index to a multiplicity of different positions facing the individual cells in order to extract (retrieve) the tank rounds from the cells incident to loading the cannon. Thus, a passive magazine can be of a simple, straight forward design. However, the autoloader design must be highly complex in order to achieve the requisite indexing movements to the locations of the stationary magazine cells. Also, valuable space must be allotted to accommodate the indexing retrieval motions of the autoloader.

In the active magazine design approach, the cells are moveable, in that they are indexed one-by-one to a single retrieval location to which the autoloader is positioned to successively extract the tank rounds from the cells incident to loading the cannon. This approach adds complexity to the magazine, but significantly simplifies the autoloader design.

Moreover, since indexing retrieval motion of the autoloader is avoided, valuable space is saved. Also, the active magazine design approach is more conducive to automated reloading, either from a resupply vehicle or at an ammunition depot.

SUMMARY OF THE INVENTION

It is accordingly an objective of the present invention to provide an improved active ammunition magazine. A further objective of the present invention is to provide an active ammunition magazine that is ideally suited to serve an automated cannon loading system. Yet another objective is to provide an active ammunition magazine that achieves a high storage density, is economical in construction, has a low parts count, and is efficient and reliable in operation.

To achieve these objectives the ammunition magazine of the present invention comprises a housing having a downloading port and an endless ammunition conveyor contained by the housing. The ammunition conveyor includes a series of units, each unit including a pair of rigidly joined cells, with each cell adapted to retain an ammunition round. The units are pivotally interconnected by connectors to form a conveyor chain, and a drive chain is coupled to the conveyor chain for indexing the cells along a serpentine path successively to an extraction position confronting the port, through which downloading of the ammunition rounds is conducted.

Further in accordance with the above objectives, the present invention provides an ammunition conveyor that comprises a housing having an ammunition port and in which is contained an ammunition conveyor. The ammunition conveyor includes an endless succession of cells interconnected by a single conveyor chain running in a common vertical plane. Members are included with the housing to guide the cells during conveyance along a serpentine path including multiple tiers of horizontal runs and connecting 180° and 90° turns. Plural sprockets included in a conveyor drive train drivingly engage the chain conveyor to index the cells into an extraction position facing the port, through which downloading of the ammunition rounds is conducted.

Additional features, advantages, and objectives of the present invention will be set forth in the description which follows and in part will be apparent from the description, or may be learned by practice of the invention. The objects and advantages of the present invention will be realized and attained by the apparatus particularly pointed out in the following written description and the appended claims, as well as in the accompanying drawings.

It will be understood that both the foregoing general description and the following detailed description are exemplary and explanatory and are intended to provide a complete description of the invention as claimed.

The accompanying drawings are intended to provide a further understanding of the invention and are incorporated in and constitute a part of the specification, illustrate a preferred embodiment of the invention, and, together with the description, explain the principles of the invention.

DETAILED DESCRIPTION OF THE PREFERRED EMBODIMENT

Figure 1:
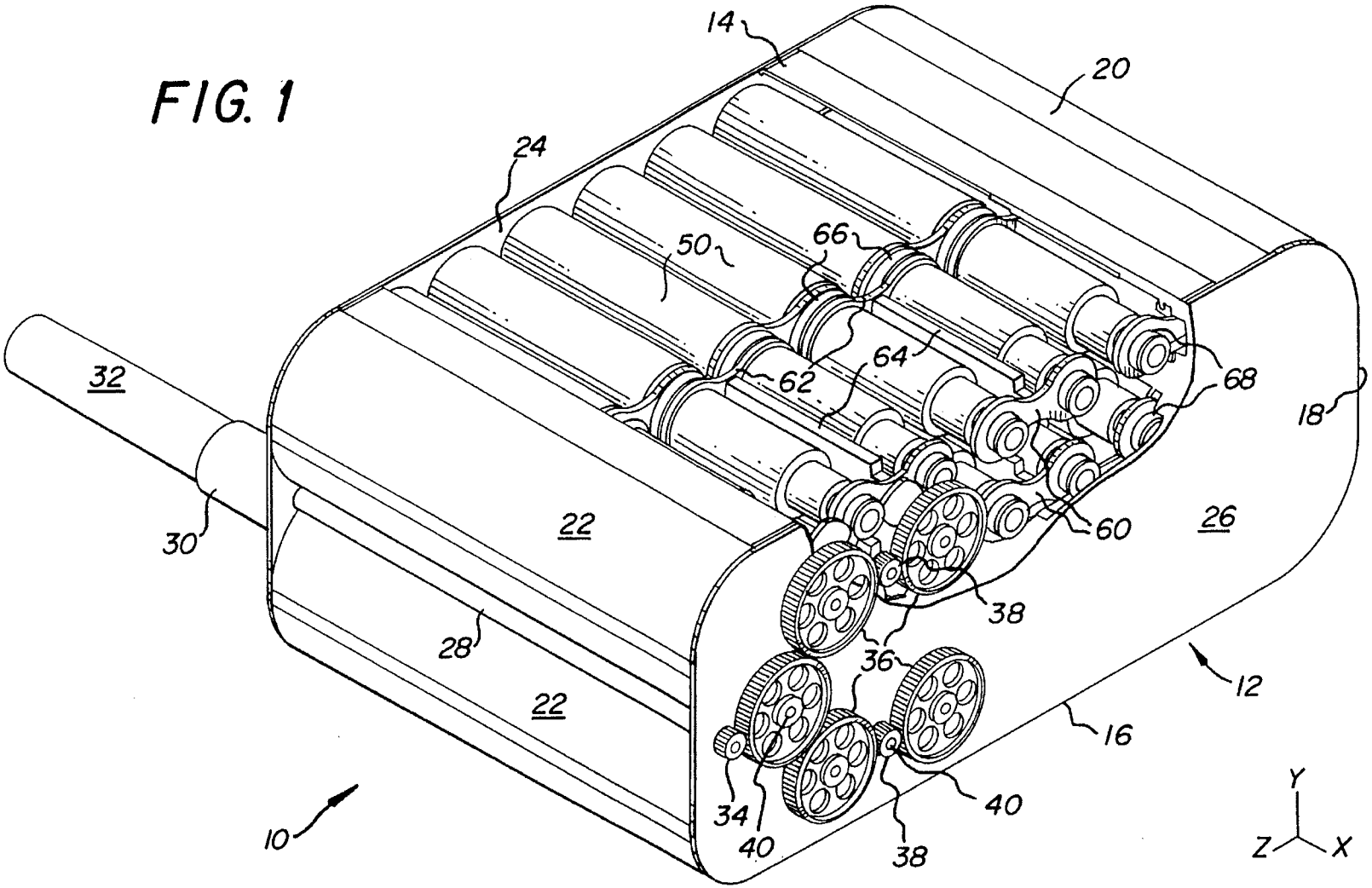
FIG. 1 is a perspective view, partially broken away, of an ammunition magazine structured in accordance with a preferred embodiment of the present invention.
Figure 3:
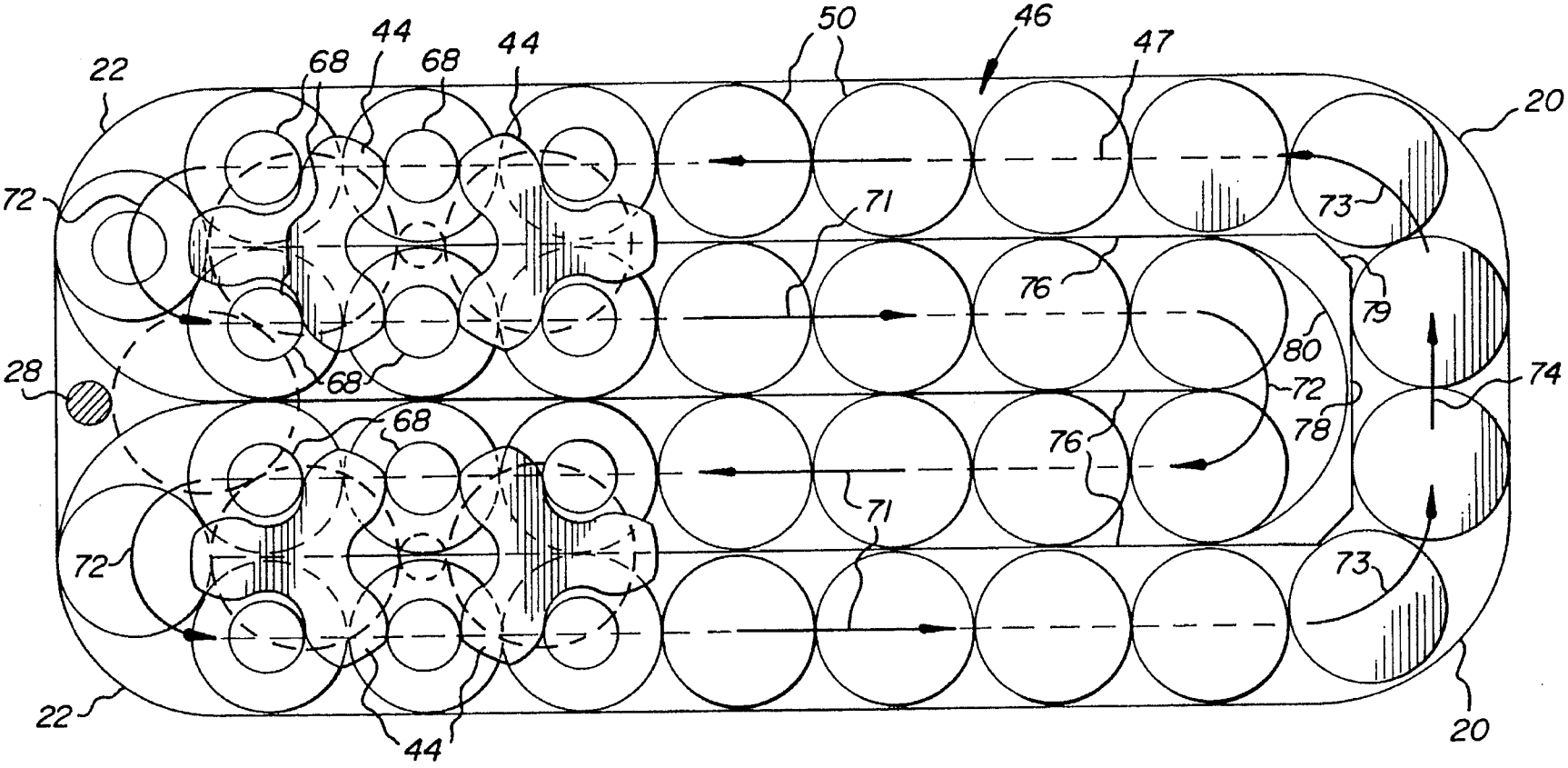
FIG. 3 is an elevational view, partially in schematic form, of the ammunition magazine of FIG. 1.

The active ammunition magazine in accordance with a preferred embodiment of the present invention, generally indicated at 10 in FIG. 1, comprises a generally rectangular housing, generally indicated at 12, having planar upper 14 and lower 16 walls, a planar endwall 18 joined to the upper and lower walls by quarter-round corner sections 20, and an opposed endwall consisting of a pair of 180° arcuate sections 22 joined together at their inner ends and respectively merged with the upper and lower walls at their outer ends, as best seen in FIG. 3. Front 24 and rear 26 walls are joined to the upper, lower, and end walls to complete the housing construction.

Figure 2:
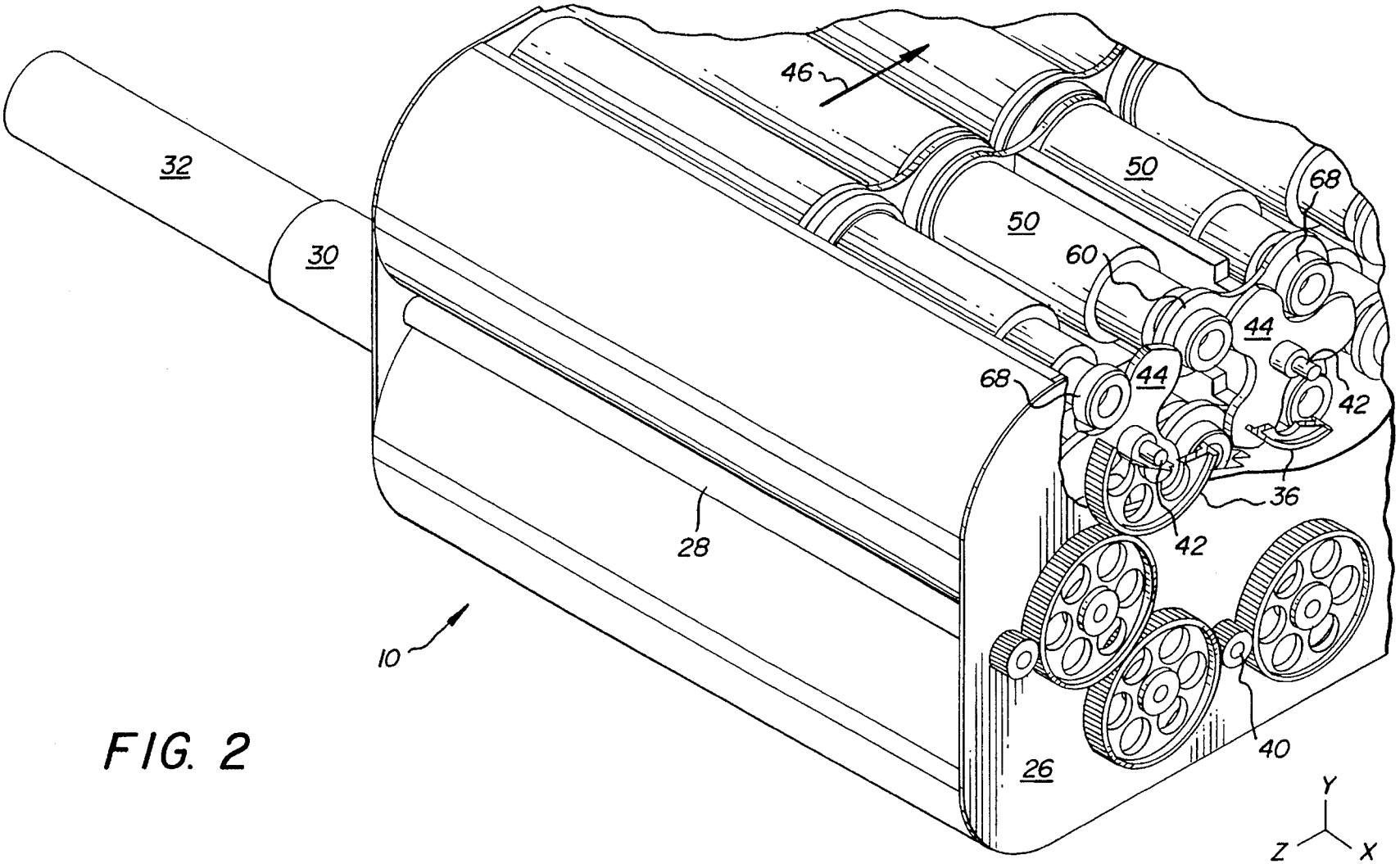
FIG. 2 is an enlarged, fragmentary perspective view, partially broken away, of the ammunition magazine of FIG. 1.

As seen in both FIGS. 1 and 2, an elongated drive shaft 28 extends through the recess between the 180° arcuate endwall sections 22 and is journaled adjacent its ends by the front 24 and rear 26 walls. The drive shaft end extending beyond front wall 24 is connected to a gear box 30 driven by a motor 32 that may be either electrically or hydraulically powered. The drive shaft end extending beyond rear wall 26 is keyed to a pinion gear 34 that provides input power to a gear train consisting of a cluster of intermeshing spur gears 36 and direction-changing idler gears 38. The idler gears 38 are carried by short stub shafts 40 journaled by the rear wall, while spur gears 36 are carried on longer stub shafts 42 also journaled by the rear wall. The inner ends of stub shafts 42, extending into the housing interior, are keyed to sprockets 44. As described below, the gear train distributes input power from motor 32 to the sprockets 44, which are drivingly coupled to translate an endless ammunition conveyor, generally indicated at 46 and best seen in FIG. 3, along a serpentine path.

Figures 4, 6:
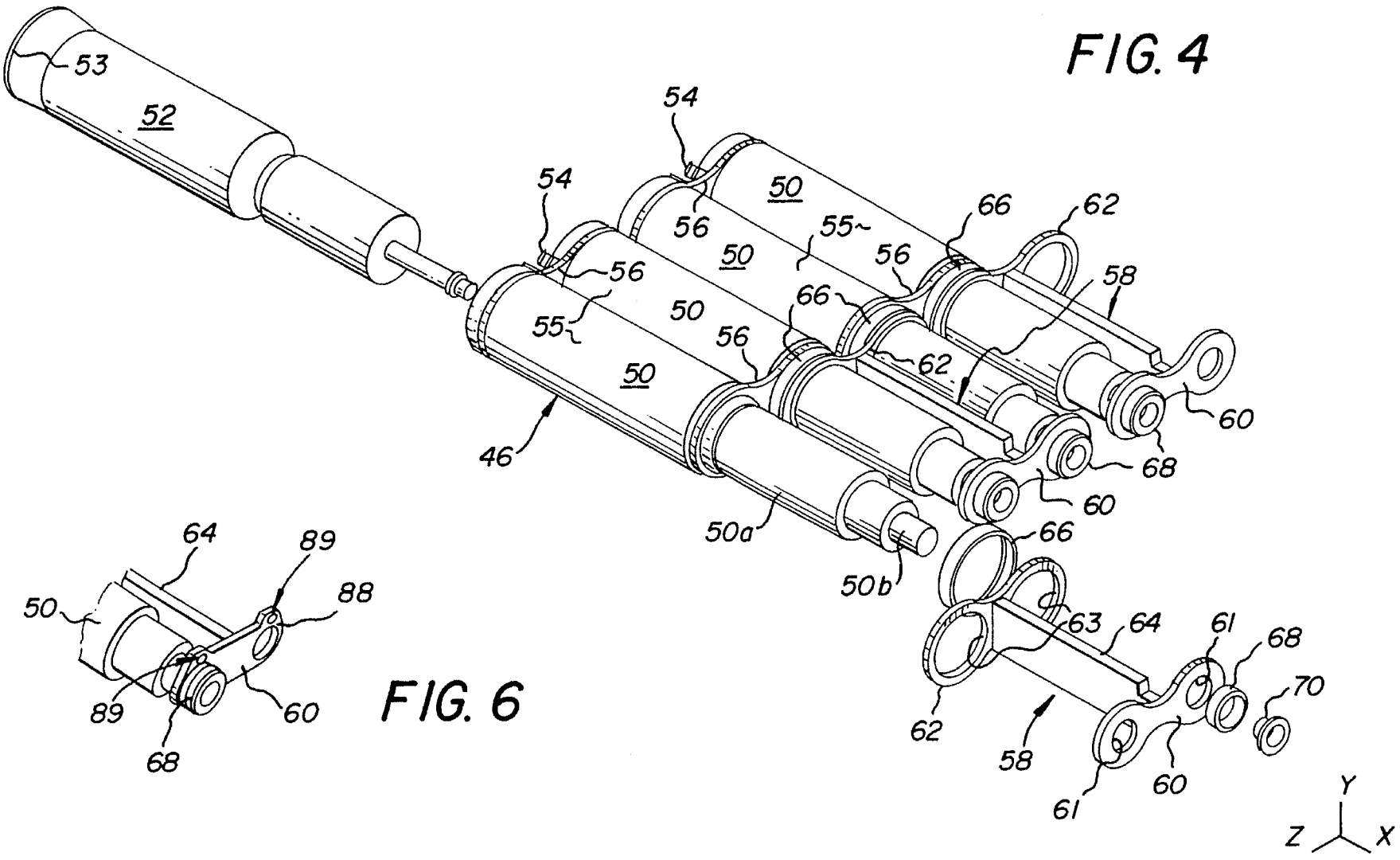
FIG. 4 is an exploded, perspective view of a section of an ammunition conveyor contained in the ammunition magazine of FIG. 1.
FIG. 6 is a fragmentary, perspective view of a modified chain link that may utilized in the ammunition conveyor seen in FIG. 4.

As best seen in FIG. 4, ammunition conveyor 46 includes a series of cells in the form of tubes 50 manufactured of a suitable material, such as aluminum. The tubes are internally configured to conform to the shape of an ammunition round 52, such as to slidingly receive the round in a snug, close-fitting manner. Once fully received in the tubes, the rounds are releaseably retained in place by spring latches 54 located at the open butt ends of the tubes 50 in positions to engage extraction rims 53 provided at the butt ends of the rounds 52. Front magazine wall 24 is in closely spaced relation to the butt ends of the tubes to maintain the ammunition rounds substantially fully received in the tubes, should the rounds be jarred free of the latches 54 during transit over rough terrain.

The tubes 50 are grouped as a series of units 55, each consisting of a pair of tubes that are rigidly joined together by webs 56 secured to the paired tubes at axially spaced locations adjacent their butt ends and approximate mid-length points by suitable means, such as weldments. Then, in accordance with a feature of the present invention, the tube units 55 are pivotally interconnected by chain connectors, generally indicated at 58 in FIG. 4. Each chain connector 58 includes an outer chain link 60 and an inner chain link 62 joined to opposite ends of an elongated bar 64 by suitable means, such as welding. The bar thus rigidly maintains links 60 and 62 in spaced parallel relation. The inner chain link 62 is provided with circular holes 63 sized to slide onto stepdown forward cylindrical sections **50*a* of adjacent tubes 50 of a consecutive pair of tube units 55, while the outer chain link 60 is provided with circular holes 61 sized to slide onto further necked down cylindrical noses 50*b*** at the forward ends of the same two tubes.

Prior to the assembly of the chain connectors to the tubes, a guide roller 66 is slidingly assembled on the forward cylindrical section **50*a* of each tube. Preferably, these guide rollers are in the form of inner and outer races with ball bearings captured therebetween. Upon assembly of the chain connectors 58, the guide rollers are captured in place between the mid-length webs 56 and the inner links 62. Completing the chain connector assembly, drive rollers 68 are slidingly assembled on the tube noses 50*b* extending beyond the outer links 60, and end caps 70** are then affixed to the tube noses to secure the assembly.

Returning to FIG. 3, the rigidly interconnected pairs of tubes 50 and the pivotally interconnected tube units 55, comprising endless ammunition conveyor 46, are arranged in a serpentine path 47 consisting of tiered horizontal runs indicated by arrows 71, connecting 180° turnarounds indicated by arrows 72, a pair of 90° turns indicated by arrows 73, and a short vertical run, indicated by arrow 74, that provides a return path between the upper and lowermost horizontal runs. Horizontal partitions 76, spanning the interior of housing 12 between the front 24 and back 26 walls, separate the horizontal runs 71, as well as provide support and guidance for the tubes 50 and their ammunition cargo during conveyance. It is seen that the upper housing wall 14 cooperates with the upper partition 76 in the guidance of the tubes moving in the upper horizontal run, while the lower housing wall 16 provides support and, in conjunction with the lower partition 76, guidance for the tubes moving in the lower horizontal run.

The upper ends of the upper and lower partitions 76 adjacent housing endwall 18 are connected to an internal vertical partition 78 by angled corner sections 79 that cooperate with endwall 18 and housing corner sections 20 in guiding the tubes through vertical run 74 and the 90° turns 73. At the opposite housing end, the arcuate endwall sections 22 guide the tubes 50 through the compact, exterior 180° turnarounds 72. Finally, to control the tubes moving through the interior 180° turnaround, an arcuate guide plate 80 is installed to span the housing interior between the front and back housing walls. It will be appreciated that, while only four tiers of horizontal runs are illustrated, the magazine capacity can be expanded by adding tiers or otherwise increasing the length of ammunition conveyor 46, if space is available.

Referring jointly to FIGS. 2 and 3, ammunition conveyor 46 is propelled by the engagements of sprockets 44 with the drive rollers 68 included in the chain connector assemblies 58 (FIG. 4). In accordance with a feature of the present invention, each sprocket 44 is positioned to perform double duty by drivingly engaging drive rollers 68 of connector assemblies moving in opposite directions in adjacent horizontal runs 71, as best seen in FIG. 3. Moreover, each sprocket includes only three teeth appropriately configured to achieve optimum drive angles with the multiple drive roller 68 in the adjacent horizontal runs. As a result, fewer drive sprockets are required, just four drive sprockets in the illustrated embodiment, and the spacings between tubes 50 in the adjacent horizontal runs is reduced to an absolute minimum essentially equal to the requisite gauge of partition 76.

As a further important feature of the present invention, by rigidly joining pairs of tubes 50 into units that, in turn, are pivotally interconnected by the chain connectors 58, reliable conveyance can be achieved using a single conveyor chain running in a vertical plane approximate vertical back wall 26. This feature affords a singular advantage over prior ammunition chain conveyors for active magazines that require a pair of parallel, driven chains that are connected to opposite ends of each and every one of the magazine cells. Thus, the present invention provides an active magazine having a dramatically simplified drive train that affords significant reductions in parts count, which translates into economies in cost, size, and weight. Moreover, it is seen that the plural gears 34, 36 and 38 of the gear train driving conveyor sprockets 44 can occupy a common vertical plane in proximate relation to the outer surface of vertical housing wall 26, thus contributing to the compactness of magazine 10.

Figure 5:
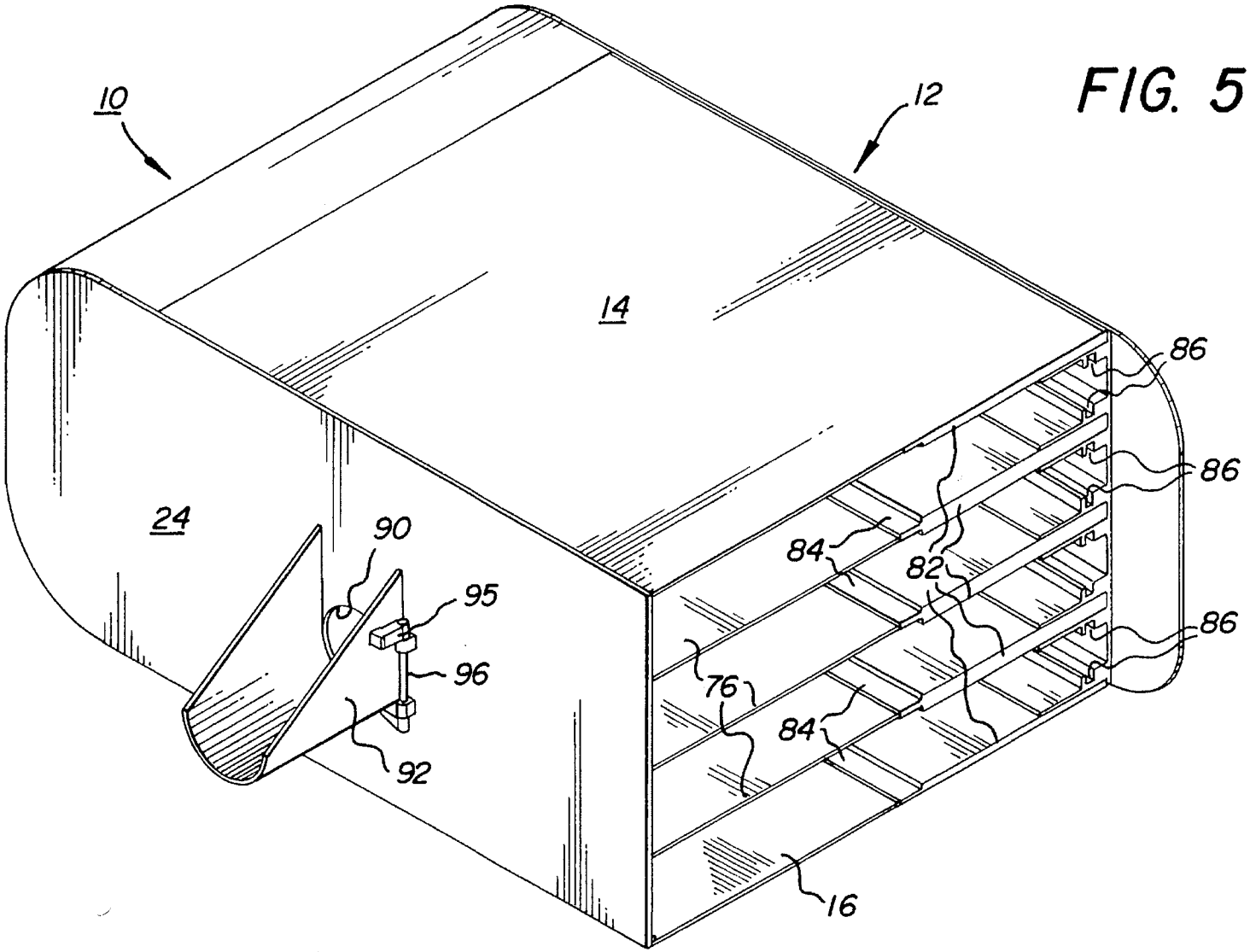
FIG. 5 is a perspective view of the ammunition magazine of FIG. 1, with one of the end walls of the magazine housing removed.

FIG. 5 illustrates additional features of the present invention with regard to facilitating and controlling the conveyance of tubes 50 along the serpentine conveyor path 47. In this regard, partitions 76 and the interior surfaces of upper 14 and lower 16 walls are provided with guidance panels 82 that extend in flanking relation along the full length of the horizontal runs 71 of the serpentine conveyor path. These panels include coextensive, recessed tracks 84 that provide smooth running surfaces for guide rollers 66 (FIG. 4). The vertical spacings between opposed tracks 84 is slightly greater than the guide roller outer diameter, such that the guide rollers only run on the lower tracks. However, vertical side walls extending along the tracks are in positions to engage the guide rollers sides to provide lateral guidance and control of ammunition conveyor movement. Additionally, the panels 82 are provided with coextensive grooves 86, in which upper and lower edge portions of the outer links 60 run for further lateral guidance and control exerted by the grooved side walls. As illustrated in FIG. 6, that outer link 60 may be equipped with vertically protruding ears 88 serving to mount miniature rollers 89 that run in the grooves 86 and roll against one or the other of the opposed groove sidewalls to provide lateral guidance and control with negligible drag.

As also seen in FIG. 5, a single port 90 in housing front wall 24 is provided to accommodate uploading of ammunition rounds 52 into the tubes 50 and for downloading the ammunition rounds from the tubes to an autoloader. Port 90 is located at an extraction position aligned with one of the horizontal runs, to which tubes 50 are indexed by the ammunition conveyor for uploading and downloading. A chute 92, mounted by front wall 24 and extending outwardly in underlying relation to port 90 provides support for the ammunition rounds as they are uploaded and downloaded.

Figure 7:
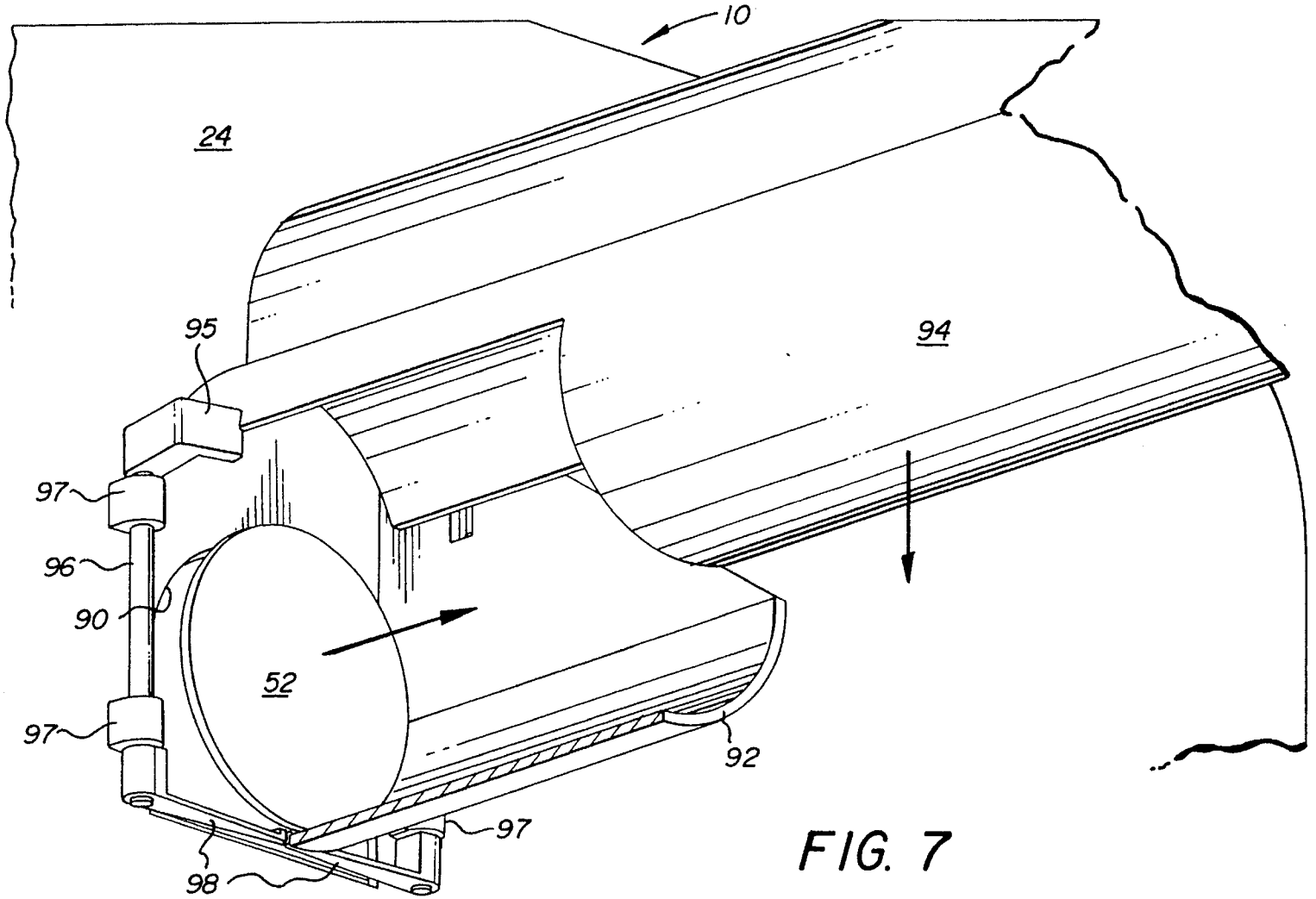
FIG. 7 is a fragmentary perspective view illustrating downloading of the ammunition magazine of FIG. 1 to autoloading apparatus for a tank cannon.

FIG. 7 illustrates a retrieval or input portion 94 of a tank cannon autoloader that is articulated downwardly into a position facing port 90 to accept a downloading of an ammunition round 52. During this downward movement, the autoloader engages actuators 95 affixed to the upper ends of vertical shafts 96 rotatably mounted to the housing front wall 24 by brackets 97 in horizontally flanking relation to port 90. Affixed to the lower ends of these shafts are elongated, spring-loaded extractor pawls 98 equipped with upstanding tips poised in extracting relation with the extractor rim 53 of the ammunition round 52 residing in the tube 52 that has been indexed to the extraction position facing port 90 by the ammunition conveyor. The camming engagements of the actuators 95 by the autoloader produces rotations of shafts 96 and outwardly swinging movements of pawls 98 defeat the spring latches 54 incident to extracting the ammunition round 52 partially out of the tube 50 and onto chute 92, such that the autoloader can acquire control of the ammunition round and complete the extraction. As the autoloader moves upwardly to begin the operation of autoloading the tank cannon, actuators 95 are released and pawls 98 spring inwardly to normal extracting positions awaiting indexation of the next ammunition round to the extraction position facing port 90.

It will be appreciated that magazine 10 readily accommodates uploading of ammunition rounds into tubes successively indexed to the extraction position facing port 90. Uploading may be performed manually or by automated ammunition handling equipment carried by a resupply vehicle or automated ammunition handling equipment located at an ammunition depot.

The magazine cells that retain the ammunition rounds 53 are preferably in the form of tubes 50 that can maximize retention and protection of the ammunition round during conveyance by the ammunition conveyor and during vehicular transit. Since, in accordance with the present invention, the single conveyor chain of the magazine conveyor can be located adjacent one ends of the magazine cells, axial uploading and downloading of ammunition rounds to and from the cells at their other ends is not impeded by a second conveyor chain. However, it will be appreciated that the numerous advantages afforded by a single chain magazine conveyor can be realized using other forms of cells, such as side-loading buckets and clam shells, for example.

It will be apparent to those skilled in the art that various modifications and variations can be made in the ammunition magazine of the present invention without departing from the spirit of the present invention. Thus, it is intended that the present invention cover modifications and variations thereof, provided they come within the spirit of the present invention. Thus, it is intended that protection for the present invention extend to modifications and variations thereof, provided they come within the scope of the appended claims and equivalents thereof.

What is claimed is:

1. An ammunition magazine comprising, in combination:

a housing having a port;

an endless ammunition conveyor contained by the housing, the ammunition conveyor including:

a series of units, each said unit including a pair of cells rigidly joined to prevent all movements relative to each other, each said cell adapted to retain an ammunition round, and connectors pivotally interconnecting the units to form a conveyor chain; and a drive train coupled to the conveyor chain for indexing the cells along a serpentine path successively to an extraction position confronting the port, through which downloading of the ammunition rounds is conducted.

2. The ammunition magazine defined in claim 1, wherein the housing is equipped with members positioned to guide the units conveyed along the serpentine path.

3. The ammunition magazine define in claim 2, wherein the connectors are aligned in a first common plane and constitute the sole pivotal interconnections of the units.

4. The ammunition magazine defined in claim 3, wherein the drive train includes plural drive sprockets rotating in a second common plane proximate and parallel to the first common plane, the drive sprockets drivingly engaging the conveyor chain.

5. The ammunition magazine defined in claim 4, wherein the first and second common planes are proximate and parallel to an inner surface of one housing wall, and the drive train further includes plural gears rotating in a drive plane proximate and parallel to an outer surface of the one housing wall, the gears respectively drivingly connected to the drive sprockets through the one housing wall.

6. The ammunition magazine defined in claim 5, wherein the port is provided in another housing wall opposed to the one housing wall.

7. The ammunition magazine defined in claim 2, wherein each said connector includes first and second links rigidly connected in parallel, spaced relation by a bar, each of the first and second links having a pair of circular holes respectively located adjacent opposed ends thereof for respectively receiving cylindrical portions of adjacent said cells of consecutive said units in pivotal connection.

8. The ammunition magazine defined in claim 7, wherein each said cell is in the form of an elongated tube internally configured to receive an ammunition round in snug relation.

9. The ammunition magazine defined in claim 8, further comprising a guide roller rotatably mounted by each said cell in position to roll on running tracks provided by the guide members.

10. The ammunition magazine defined in claim 8, wherein the holes of each said first link respectively receive cylindrical noses at corresponding one ends of the adjacent cells, and the drive train includes plural drive sprockets, the ammunition conveyor further including a drive roller rotatably received on the cylindrical nose of each said cell for driving engagement by the drive sprockets.

11. The ammunition conveyor defined in claim 10, wherein each said cell includes an open end opposite the cylindrical nose through which an ammunition round is received, and a spring latch positioned adjacent the open cell end to engage an extraction rim of an ammunition round fully received in the cell.

12. The ammunition magazine defined in claim 7, wherein the connectors are aligned in a common plane and constitute the sole pivotal interconnections of the units.

13. The ammunition magazine defined in claim 1, wherein the drive train includes plural sprockets, each said sprocket drivingly coupled to the conveyor chain at multiple locations in adjacent parallel runs of the serpentine path moving in opposite directions.

14. The ammunition magazine defined in claim 1, wherein each said connector includes a link having a pair of circular holes respectively located adjacent opposed ends of the link and in which cylindrical portions of adjacent cells of consecutive units are respectively received in pivotal connection.

15. An ammunition magazine comprising, in combination:

a housing having a port;

an ammunition conveyor contained by the housing, the ammunition conveyor including an endless succession of cells interconnected by only a single conveyor chain running in a common vertical plane;

members included with the housing for guiding the cells during conveyance along a serpentine path including multiple tiers of horizontal runs and connecting 180° and 90° turns; and a conveyor drive train including plural sprockets drivingly engaging the single conveyor chain to index the cells into an extraction position facing the port through which downloading of the ammunition rounds is conducted.

16. The ammunition magazine defined in claim 15, wherein the vertical plane is located at corresponding one ends of the cells.

17. The ammunition magazine defined in claim 16, wherein the vertical plane is located proximate one wall of the housing and the port is provided in another wall of the housing opposed to the one wall.

18. The ammunition magazine defined in claim 17, wherein the extraction position is aligned with one of the horizontal runs.

19. The ammunition magazine defined in claim 18, wherein each said cell is in the form of an elongated tube internally configured to receive an ammunition round in snug relation.

20. The ammunition magazine defined in claim 19, wherein each said cell includes a spring latch positioned adjacent an open tube end opposite the cell one end to resiliently engage an extraction rim of an ammunition round fully loaded into the cell through the open tube end.

21. The ammunition magazine defined in claim 20, further including at least one extractor pawl pivotally mounted to the other housing wall proximate the port, the extractor pawl normally positioned in extracting relation with the extraction rim of an ammunition round in the cell indexed to the extraction position and pivotally actuated in response to retrieval positioning of an autoloader to partially extract the ammunition round from the cell and out through the port to an extent enabling the autoloader to acquire control of the ammunition round.

22. The ammunition magazine defined in claim 16, wherein the conveyor chain includes a series of chain connectors pivotally interconnecting consecutive units, each said unit consisting of at least two said cells of said endless succession of cells in rigid interconnection.

23. The ammunition magazine defined in claim 22, further comprising a guide roller fitted on each said cell in position to roll on horizontal guide tracts carried by the guiding members.

24. The ammunition magazine defined in claim 23, wherein each said connector includes a link having a pair of circular holes respectively located adjacent opposed ends of the link and in which cylindrical portions of adjacent said cells of consecutive said units are respectively received in pivotal connection.

25. The ammunition magazine defined in claim 24, wherein the guide members include elongated grooves position to receive edge positioned of the links for lateral guidance of the conveyor chain.

26. The ammunition magazine defined in claim 25, the edge portions of the links mount lateral guidance rollers.

* * * * *

UNITED STATES PATENT AND TRADEMARK OFFICE

CERTIFICATE OF CORRECTION

PATENT NO. : 5,594,192
DATED : January 14, 1997
INVENTOR(S) : Derek A. Rodriguez It is certified that error appears in the above-indentified patent and that said Letters Patent is hereby corrected as shown below:

Column 8, line 57-58 (claim 25, lines 2-3) "position" to --positioned--
Column 8, line 58 (claim 25, line 3), "positioned" should read --portions--.

Signed and Sealed this

Tenth Day of February, 1998

Bruce Lehman

*Attest:*

BRUCE LEHMAN

*Attesting Officer*

*Commissioner of Patents and Trademarks*